United States Patent [19]

Kato et al.

[11] Patent Number: 4,897,328

[45] Date of Patent: Jan. 30, 1990

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 188,824

[22] Filed: May 2, 1988

[30] Foreign Application Priority Data

May 1, 1987 [JP] Japan ..... 62-106417
Jun. 19, 1987 [JP] Japan ..... 62-151507

[51] Int. Cl.[4] ..... G03G 13/28
[52] U.S. Cl. ..... 430/49; 430/66
[58] Field of Search ..... 430/192, 49, 96, 66

[56] References Cited

U.S. PATENT DOCUMENTS 4,673,627 6/1987 Kunichika et al. ..... 430/49
4,724,195 2/1988 Müller et al. ..... 430/49

*Primary Examiner*—John L. Goodrow
*Attorney, Agent, or Firm*—Sughrue, Mion, Zinn, Macpeak & Seas

[57] ABSTRACT

An electrophotographic lithographic printing plate precursor comprising an electrophotographic photoreceptor which comprises a conductive support having thereon at least one photoconductive layer and an outermost surface layer which is used for producing an image on the photoconductive layer and then subjecting the layer to an oil-desensitization treatment is disclosed. The surface layer contains, as main component, at least one resin selected from the group consisting of (A) a resin obtained by polymerizing at least one monomer having at least one functional group which is capable of forming a hydroxyl group upon decomposition by the oil-desensitization treatment and which is represented by formula:

—O—L wherein L is as defined in the specification, in the side chain thereof, and (B) a resin obtained by polymerizing at least one monomer having at least one functional group in which at least two hydroxyl groups sterically near to each other are simultaneously protected with one protective group, and which is capable of forming at least two hydroxyl groups upon decomposition by the oil-desensitization treatment. The surface layer achieves both high hydrophilic properties and water resistance in good compatibility after oil-desensitization processing to produce a printing plate having excellent resistance to background stains and printing durability.

11 Claims, No Drawings

ELECTROPHOTOGRAPHIC LITHOGRAPHIC PRINTING PLATE PRECURSOR

FIELD OF THE INVENTION

This invention relates to an electrophotographic lithographic printing plate precursor, and, more particularly, to a lithographic printing plate precursor having a photoconductive layer on which a surface layer having specific properties is provided.

BACKGROUND OF THE INVENTION

A number of offset printing plate precursors for directly producing printing plates have hitherto been proposed, and some of them have already been put into practical use. Widely employed among them is a system in which a photoreceptor comprising a conductive support having provided thereon a photoconductive layer mainly comprising photoconductive particles, e.g., zinc oxide, and a resin binder is subjected to ordinary electrophotographic processing to form a highly lipophilic toner image thereon, and the surface of the photoreceptor is then treated with an oildesensitizing solution called an etching solution to selectively render non-image areas hydrophilic to obtain an offset printing plate.

Requirements of offset printing plate precursors for obtaining satisfactory prints are such that: an original should be reproduced faithfully on the photoreceptor; that the surface of a photoreceptor has affinity with an oildesensitizing solution so as to render non-image areas sufficiently hydrophilic and, at the same time, has water resistance; and that a photoconductive layer having formed thereon an image is not attenuated during printing and is sufficiently receptive to dampening water so that the non-image areas retain the hydrophilic properties enough to exhibit freedom from stains even on printing a large number of prints.

For a particular use as an offset printing plate precursor, formation of background stains due to insufficient oil-desensitivity presents a serious problem. In order to solve this problem, various resins as binders for zinc oxide have been proposed, for example, as disclosed in Japanese Patent Publication No. 31011/75, Japanese Patent Application (OPI) Nos. 54027/78, 20735/79. 202544/82, and 68046/83 (the term "OPI" as used herein means an "unexamined published Japanese patent application"). Nevertheless, actual evaluations of these resins proposed for improving oil-desensitivity revealed that none of the lithographic printing plate precursors containing them was satisfactory in terms of stain resistance and printing durability.

On the other hand, a photoconductive layer comprising particles of an organic photoconductive compound and a binder resin can be formed on a grained aluminum base. Printing plate precursors of this type can be produced by forming a toner image on a photosensitive layer through the known electrophotographic processing as described above and removing the non-image areas by eluting with a processing solution, whereby the aluminum base corresponding to the non-image areas is exposed to form hydrophilic areas. The photosensitive layer using the organic photoconductive compound comprises, for example, an oxadiazole compound or oxazole compound and an alkali-soluble binder resin, e.g., a styrene-maleic anhydride copolymer, etc., as disclosed in Japanese Patent Publication Nos. 17162/62 and 39405/71 and Japanese Patent Application (OPI) Nos. 2437/77 and 107246/81; or a phthalocyanine pigment or azo pigment and an alkali-soluble phenolic resin as disclosed in Japanese Patent Application (OPI) Nos. 105254/80, 16125/70, 150953/83, and 162961/83.

However, since the above-mentioned plate making process involves removal of the photosensitive layer corresponding to the non-image areas by dissolution, it requires a large-sized apparatus and is too time-consuming to achieve a reasonable production rate. Besides, use of an organic solvent as processing solution, such as ethylene glycol, glycerin, methanol, ethanol, etc., encounter problems of cost safety, environmental pollution, working hygiene, and the like.

It has been proposed to provide a specific resin layer capable of being rendered hydrophilic on a usual electrophotographic photoreceptor as described in Japanese Patent Publication No. 5606/70. According to this system, a surface layer comprising a vinyl ether-maleic anhydride copolymer and a hydrophobic resin compatible with the copolymer is provided on the photosensitive layer. After toner image formation, the non-image areas of the surface layer can be rendered hydrophilic by treating with an alkali to hydrolytically open the anhydride ring.

However, since the vinyl ether-maleic anhydride copolymer used in the surface layer becomes water-soluble upon ring-opening, the surface layer is seriously inferior in water resistance even when the surface layer is composed of the vinyl ether-maleic anhydride copolymer in combination with other compatible hydrophilic resins. Therefore, printing durability of the resulting printing plate is only about 500 to 600 prints at most.

It has also been proposed to form a surface layer capable of being rendered hydrophilic, which comprises silylated polyvinyl alcohol as a main component and a crosslinking agent as disclosed in Japanese Patent Application (OPI) Nos. 90343/85, 159756/85, and 217292/86. According to this proposal, after toner image formation, the surface layer on the non-image area can be rendered hydrophilic by hydrolysis of the silylated polyvinyl alcohol. Further, in order to retain film strength after becoming hydrophilic, the degree of silylation of polyvinyl alcohol is so controlled, and the remaining hydroxyl groups are crosslinked by the crosslinking agent.

The above publications describe that the provision of such a surface layer would prevent background stains of prints and increase printing durability. However, it has been determined by evaluation under conditions of actual use that the resulting printing plate still does not satisfy the stain resistance requirement. The above method has the further disadvantages as follows. In nature of high-molecular reaction, it is difficult to stably produce the silylated polyvinyl alcohol having a desired degree of silylation and to quantitatively react the functional groups in the polymer. Quantitative determination of the reaction degree requires an expensive and highly precise analytical instrument. The method involves incorporation of by-products or impurities resulting from the high-molecular reaction and the like into the product, which is unfavorable for stabilization of performance, such as electrophotographic characteristics. The residual hydroxyl groups cannot be completely crosslinked even by using a crosslinking agent, and the surface layer is rendered conductive by the remaining hydroxyl groups and, therefore, becomes liable to cause charge leakage. As a result, the surface layer can hardly hold insulation quality equal to that of a photosensitive layer, thus making it difficult to avoid adverse influences on the surface layer, such as reduction in exposure sensitivity. In addition, the chemical structure of the hydrophilic polymer has limitations which make it difficult to improve charging properties and quality of a reproduced image (e.g., dot reproducibility and resolving power of image areas, resistance to background fog of non-image areas, etc.) without adversely influencing other qualities of an electrophotographic photoreceptor.

Furthermore, the above method entails cost since achievement of sufficient hydrophilic properties after hydrolysis requires a relatively large quantity of silylated polyvinyl alcohol. Besides, considering the whole balance of performance, such as electrophotographic characteristics, film-forming properties, etc., there is only a narrow choice of material composition.

SUMMARY OF THE INVENTION

One object of this invention is to provide a lithographic printing plate precursor which reproduces an image faithful to an original, forms neither background stains evenly over the entire surface nor dot-like stains, and exhibits excellent oil-desensitivity.

Another object of this invention is to provide a lithographic printing plate which retains sufficient hydrophilic properties on its non-image areas so as to exhibit stain resistance and high printing durability even when used for printing a large number of prints.

A further object of this invention is to provide a lithographic printing plate precursor having a surface layer to be rendered hydrophilic on non-image areas, the surface layer comprising a resin which can be synthesized easily.

A still further object of this invention is to provide a lithographic printing plate precursor which can be produced at a relatively low cost and allowed a wide choice in material composition to aquire a broad range of electrophotographic characteristics, film-forming properties, and the like.

It has now been found that the above objects of this invention can be accomplished by a lithographic printing plate precursor comprising an electrophotographic photoreceptor which comprises a conductive support having provided thereon at least one photoconductive layer and an outermost surface layer, used for producing an image on the photoconductive layer and then subjecting the layer to an oil-desensitization treatment, in which said surface contains, as a main component, at least one resin selected from the group consisting of (A) a resin obtained by polymerizing at least one monomer having at least one functional group which is capable of forming a hydroxyl group upon decomposition by the oil-desensitization treatment and which is represented by formula:

$$-O-L$$

wherein $L_1$ represents $$-\underset{R_3}{\overset{R_1}{\underset{|}{\overset{|}{Si}}}}-R_2,\ -CO-Y_1,\ -CO-Z-Y_2,\ -CH=CH-CH_3,$$

-continued

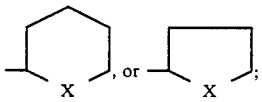

wherein $R_1$, $R_2$, and $R_3$, which may be the same or different, each represents a hydrogen atom, a hydrocarbon group or —O—R′, wherein R′ represents a hydrocarbon group; $Y_1$ and $Y_2$ each represents a hydrocarbon group; Z represents an oxygen atom, a sulfur atom or —NH—; and X represents a sulfur atom or an oxygen atom, in the side chain thereof, and (B) a resin obtained by polymerizing at least one monomer having at least one functional group in which at least two hydroxyl groups sterically near to each other are simultaneously protected with one protective group, and which is capable of forming at least two hydroxyl groups upon decomposition by the oil-desensitization treatment.

DETAILED DESCRIPTION OF THE INVENTION

The resin (A) comprising at least one monomer unit containing at least one functional group of formula (—O—L) in the side chain thereof can be obtained by polymerizing one or more of such monomers or copolymerizing one or more of such monomers with other copolymerizable monomers.

The resin (B) containing at least one functional group in which two or more hydroxyl groups sterically near to each other are protected with one protective group can be obtained by a process comprising polymerizing a monomer containing at least two hydroxyl groups which have previously been protected with one protective group or copolymerizing such a monomer with other copolymerizable monomers.

The functional group where at least one hydroxy group is protected as represented by formula (I), and the functional group where at least two hydroxyl groups are protected with one protective group as represented by formulae (II) to (V) can be formed by the method as described in literature references cited in, for example, *New Experimental Chemical Lecture,* Vol. 14, Organic Compound Synthesis and Reaction (V), p. 2505 compiled by Japan Chemical Association (published by Maruzen Publishing Co., Ltd.); T.W. Green, "Protective Groups in Organic Synthesis", Chapters 2 and 3 (John and Willey, 1981); J.F.W. Mc.Omie, "Protective Groups in Organic Chemistry", Chapters 3 and 4 (Prenum. Press), etc.

The functional group of formula (—O—L) in the resin (A) is capable of forming a hydroxyl group upon being decomposed.

In formula (—O—L), when L represents $$-\underset{R_3}{\overset{R_1}{\underset{|}{\overset{|}{Si}}}}-R_2,\ R_1,\ R_2,$$

and $R_3$ (which may be the same or different) each preferably represents a hydrogen atom, a substituted or unsubstituted straight or branched chain alkyl group having from 1 to 18 carbon atoms (e.g., methyl, ethyl, propyl, butyl, hexyl, octyl, decyl, dodecyl, octadecyl, chloromethyl, dichloroethyl, methoxyethyl, and methoxypropyl groups), a substituted or unsubstituted alicyclic group (e.g., cyclopentyl, and cyclohexyl groups), a substituted or unsubstituted aralkyl group having from 7 to 12 carbon atoms (e.g., benzyl, phenethyl, chlorobenzyl, and methoxybenzyl groups), a substituted or unsubstituted aromatic group (e.g., phenyl, naphthyl, chlorophenyl, tolyl, methoxyphenyl, methoxycarbonylphenyl, and dichlorophenyl groups), or —O—R', wherein R' represents a hydrocarbon group, and specifically the same hydrocarbon groups as above enumerated for $R_1$, $R_2$, and $R_3$.

When L represents —CO—$Y_1$, $Y_1$ preferably represents a substituted or unsubstituted straight chain or branched chain alkyl group having from 1 to 6 carbon atoms (e.g., methyl, trichloromethyl, trifluoromethyl, methoxymethyl, phenoxymethyl, 2,2,2-trifluoroethyl, t-butyl, and hexafluoroisopropyl groups), a substituted or unsubstituted aralkyl group having from 7 to 9 carbon atoms (e.g., benzyl, phenethyl, methylbenzyl, trimethylbenzyl, heptamethylbenzyl, and methoxybenzyl groups), or a substituted or unsubstituted aryl group having from 6 to 12 carbon atoms (e.g., phenyl, nitrophenyl cyanophenyl, methanesulfonylphenyl, methoxyphenyl, butoxyphenyl, chlorophenyl, dichlorophenyl, and trifluoromethylphenyl groups).

When L represents —CO—Z—$Y_2$, Y represents an oxygen atom, a sulfur atom or an —NH— bond; and $Y_2$ has the same meaning as $Y_1$.

When L represents

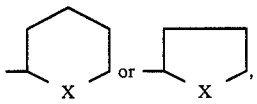

X represents an oxygen atom or a sulfur atom.

The monomer having at least one functional group of formula (—O—L) in the side chain thereof includes, for example, compounds of formula (I):

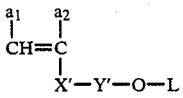

(I)

wherein X, represents —O—, —CO—, —COO—, —OCO—,

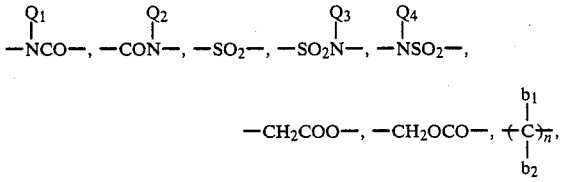

an aromatic group or a heterocyclic ring, wherein $Q_1$, $Q_2$, $Q_3$, and $Q_4$ each represents a hydrogen atom, a hydrocarbon group or the group (Y'—O—L) in formula (I); $b_1$ and $b_2$, which may be the same or different, each represents a hydrogen atom, a hydrocarbon group or the group (Y'—O—L) in formula (I); and n represents 0 or an integer of from 1 to 18; Y' represents a carbon-carbon bond connecting X' with —O—L which may contain a hetero atom (examples of a hetero atom including an oxygen atom, a sulfur atom, and a nitrogen atom), such as

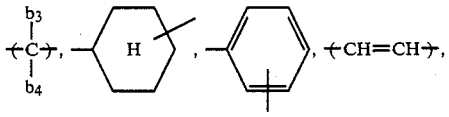

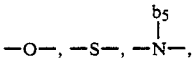

—COO—, —CONH—, —$SO_2$—, —$SO_2$NH—, —NHCOO—, —NHCONH—, etc. and combinations thereof (wherein $b_3$, $b_4$, and $b_5$ each has the same meaning as $b_1$ and $b_2$); and $a_1$ and $a_2$, which may be the same or different, each represents a hydrogen atom, a hydrocarbon group (e.g., an alkyl group having from 1 to 12 carbon atoms which may be substituted with —COOH, etc.), —COOH or —COOW, wherein W represents an alkyl group having from 1 to 18 carbon atoms, an alkenyl group, an aralkyl group, an alicyclic group or an aromatic group, each of which may be substituted with a group selected from groups including (—O—L).

Specific examples of the monomer having at least one functional group (—O—L) in its side chain are shown below for illustrative purposes only but not for limitation.

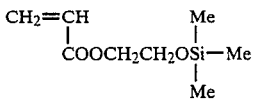

(1)

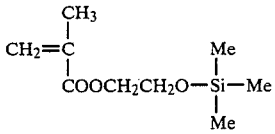

(2)

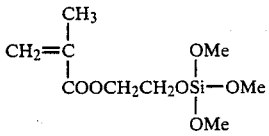

(3)

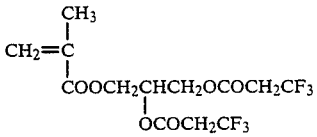

(4)

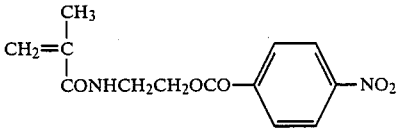

(5)

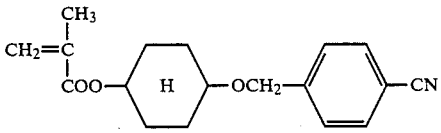

(6)

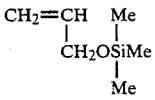

(7)

-continued (8)

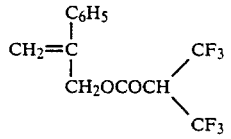

(9)

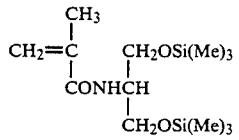

(10)

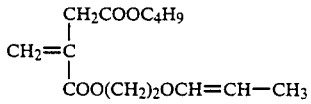

(11)

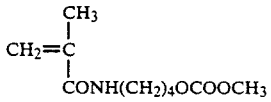

(12)

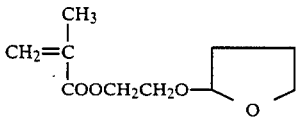

(13)

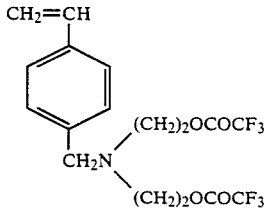

(14)

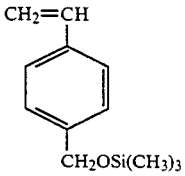

(15)

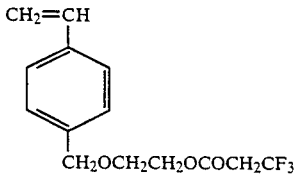

(16)

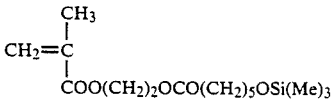

(17)

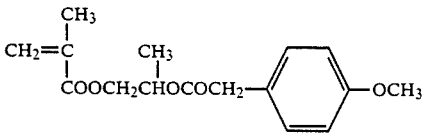

(18)

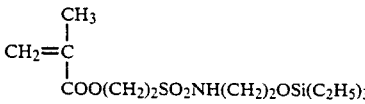

-continued (19)

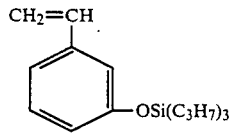

(20)

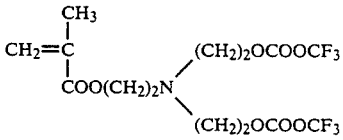

(21)

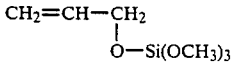

(22)

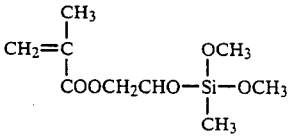

(24)

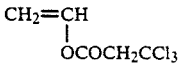

(25)

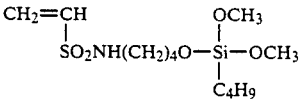

(26)

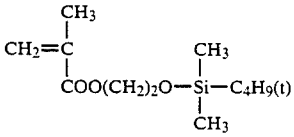

These monomers can be prepared by 1) converting a hydroxyl group(s) of a compound having a polymerizable double bond and at least one hydroxyl group to the functional group of formula (—O—L) according to, for example, the method described in Nihon Kagakukai (ed.), *Shinjikken Kagaku Koza,* Vol. 14, "Yuki Kagobutsu no Gosei to Han-no (V)", p. 2497, Maruzen K.K. or 2) reacting a compound having the functional group of formula (—O—L) with a compound having a polymerizable double bond.

With respect to the resin (B), the functional group in which at least two hydroxyl groups sterically near to each other are protected by one protective group is described below.

Examples of the functional group include those represented by formulae (II), (III), (IV), and (V):

(II)

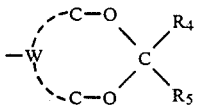

wherein $R_4$ and $R_5$, which may be the same or different, each represents a hydrogen atom, a hydrocarbon group or —O—R'', wherein R'' represents a hydrocarbon group; and W represents a carbon-carbon bond or bonding group which may contain a hetero atom, the number of atoms between the oxygen atoms being limited to 5 or less;

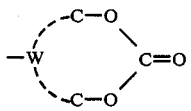

(III)

wherein W is as defined above;

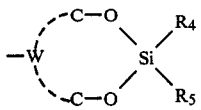

(IV)

wherein $R_4$, $R_5$, and W are as defined above; and

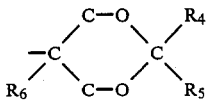

(V)

wherein $R_4$ and $R_5$ are as defined above, and $R_6$ represents a hydrogen atom or an alkyl group having 1 to 4 carbon atoms, for example, a methyl, ethyl, propyl or butyl group.

In formulae (II) to (V), $R_4$ and $R_5$ (which may be the same or different) each preferably represents a hydrogen atom, a substituted or unsubstituted alkyl group having from 1 to 12 carbon atoms (e.g., methyl, ethyl, propyl, butyl, hexyl, 2-methoxyethyl, and octyl groups), a substituted or unsubstituted aralkyl group having from 7 to 9 carbon atoms (e.g., benzyl, phenethyl, methylbenzyl, methoxybenzyl, and chlorobenzyl groups), an alicyclic group having from 5 to 7 carbon atoms (e.g., cyclopentyl and cyclohexyl groups), a substituted or unsubstituted aryl group (e.g., phenyl, chlorophenyl, methoxyphenyl, methylphenyl, and cyanophenyl groups) or —O—R″, wherein R″ represents a hydrocarbon group, and preferably those hydrocarbon groups recited for $R_4$ or $R_5$.

W represents a carbon-carbon bond which may contain a hetero atom, with the number of atoms between two oxygen atoms being limited to 5 or less.

Specific but non-limiting examples of the polymer component (repeating unit) containing the above-described functional group are shown below.

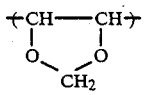

(27)

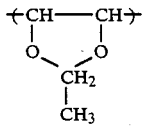

(28)

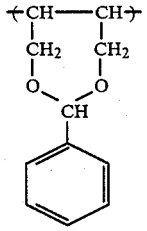

(29)

-continued

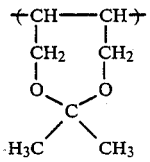

(30)

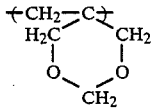

(31)

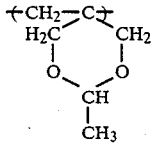

(32)

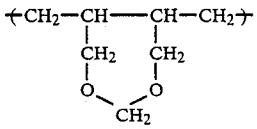

(33)

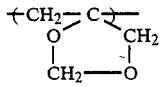

(34)

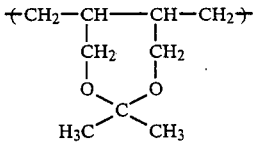

(35)

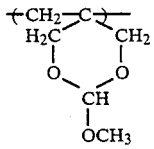

(36)

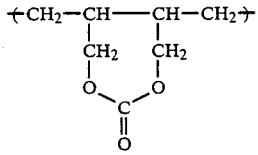

(37)

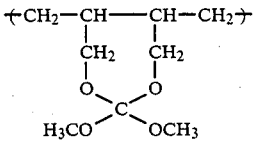

(38)

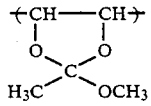

(39)

-continued (40)

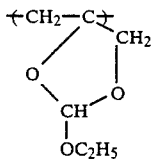

(41)

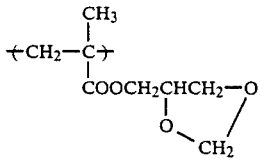

(42)

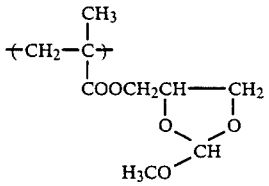

(43)

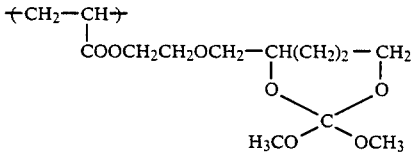

(44)

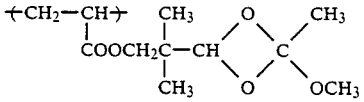

(45)

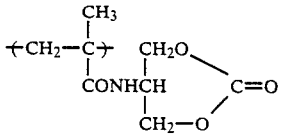

(46)

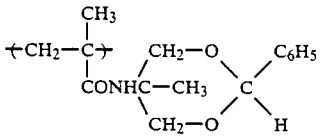

(47)

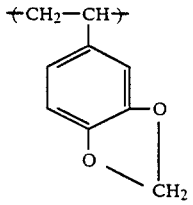

(48)

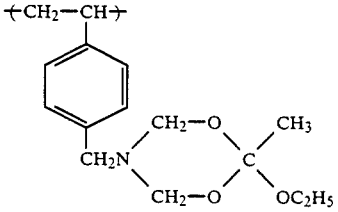

-continued (49)

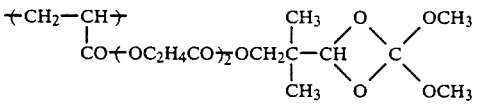

(50)

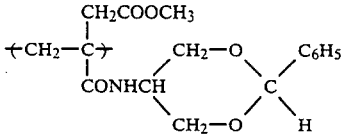

(51)

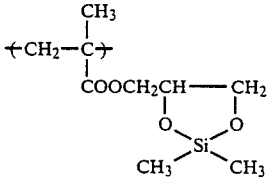

(52)

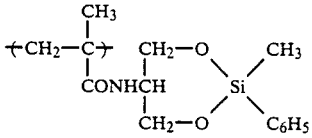

The resin which can be used in the present invention can be prepared by polymerizing at least one monomer containing the functional group or copolymerizing such a monomer with other copolymerizable monomers.

The above-described method comprising polymerization of a monomer previously containing the functional group in the side chain thereof is preferable to a method comprising converting a hydroxyl group in a polymer to a hydrophobic group because the functional group in the polymer can be controlled arbitrarily in kind and amount and also incorporated of by-products or impurities accompanying high-molecular reaction, etc. into the polymer can be avoided thereby to improve stability of performance properties, such as electrophotographic characteristics.

The above-described monomers may be copolymerized with other copolymerizable monomers having various performance properties. For example, polymer resins having a desired chemical structure can be obtained by incorporating a comonomer unit having satisfactory film-forming properties such as

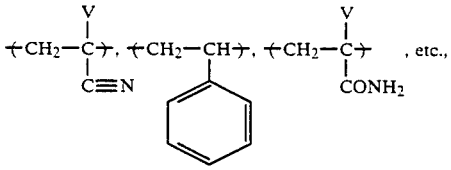

wherein V represents a hydrogen atom or an alkyl group having 1 to 4 carbon atoms (e.g., a methyl, ethyl, propyl or butyl group); and/or a reactive comonomer unit which enhances film strength through self-cross-linking, such as .

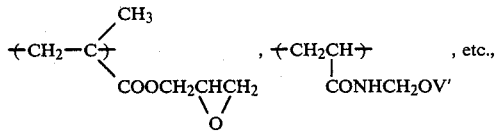

wherein V' represents a hydrogen atom or an alkyl group having 1 to 4 carbon atoms, and the like. A polymer having a sufficient film strength can also be obtained, without using any crosslinking agent, by, for example, adjusting an average molecular weight of the resulting polymer to about 100,000 or more and/or appropriately selecting a type of the comonomer used. Additional examples of the copolymerizable monomers include vinyl or allyl esters of aliphatic carboxylic acids, e.g., vinyl acetate, vinyl propionate, vinyl butyrate, allyl acetate, allyl propionate, etc.; unsaturated carboxylic acids, e.g., acrylic acid, methacrylic acid, crotonic acid, itaconic acid, maleic acid, fumaric acid, etc., and esters or amides thereof; styrene derivatives, e.g., styrene, vinyltoluene, α-methylstyrene, etc.; α-olefins; acrylonitrile, methacrylonitrile; vinyl-substituted heterocyclic compounds, e.g., N-vinylpyrrolidone, etc.; and the like.

In order to further improve the film strength of the surface layer, a crosslinking reaction can be taken advantage of as hereinafter described. To this effect, it is preferable to copolymerize a monomer containing a functional group which can easily undergo crosslinking, such as epoxy, amino, isocyanate, carboxyl and hydroxyl groups. Details for such copolymerization are described in references cited in Nihon Kgakukai (ed.), *Shinjikken Kagaku Koza,* Vol. 14, "Yuki Kagobutsu no Gosei to Han-no (V)", 2535, Maruzen K.K., and Yoshio Iwakura and Keisuke Kurita, *Han-nosei Kobunshi,* 170, Kodansha.

The resin A) or B) comprising the functional group-containing monomer component according to the present invention is a homo- or copolymer comprising from 40 to 100% by weight of a monomer component containing the functional group, and preferably a copolymer comprising from 40 to 80% by weight of such a monomer component. The resin according to the present invention has a molecular weight of from $1\times10^3$ to $1\times10^6$, and preferably from $5\times10^3$ to $5\times10^5$.

In the present invention, conventionally known resins may also be used in combination with the above-described resins according to the present invention. Such resins include silicone resins, alkyd resins, vinyl acetate resins, polyester resins, styrene-butadiene resins, acrylic resins, and the like. Specific examples of these known resins are described, e.g., in T. Kurita et al., *Kobunshi,* Vol. 17, 278 (1968), H. Miyamoto et al., *Imaging,* Vol. 1973, No. 8, 9, etc.

The mixing ratio of the resin according to the present invention and the known resin is arbitrary as far as the proportion of a component containing the functional group falls within a range of from 40 to 100% by weight, and preferably from 45 to 100% by weight, based on the total resin. If the proportion of the functional group-containing component is less than 40% by weight, the resulting lithographic printing plate precursor does not show sufficient oil-desensitivity when processed with an oil-desensitizing solution or dampening water, thus resulting in stain formation during printing.

The resin (A) or (B) according to the present invention which contains at least one functional group is capable of forming at least one hydroxyl group when hydrolyzed or hydrogenolyzed upon contact with an oil-desensitizing solution or dampening water used on printing. Therefore, when the resin is used as an outermost surface layer of a lithographic printing plate precursor, non-image areas can be rendered hydrophilic by the action of the hydroxyl group formed in the resin. As a result, a marked contrast can be afforded between lipophilic toner image areas and hydrophilic non-image areas, and adhesion of a printing ink onto the non-image areas during printing can be avoided.

In particular, the resin (B) containing at least one functional group with the two or more hydroxyl groups thereof sterically near to each other being protected with one protective group is capable of forming at least two hydroxyl groups when hydrolyzed or hydrogenolyzed upon contact with an oil-desensitizing solution or dampening water used on printing. As a result, sufficiently high hydrophilic properties can be attained to effectively produce the effects of the surface layer in spite of a small content of the functional group. Therefore, the resin can be produced at a relatively low cost. Moreover, selection may be made from a wide choice of material composition in adjusting the whole balance of performance properties, such as electrophotographic characteristics, film-forming properties, etc.

For the purpose of improving film strength of the surface layer to be rendered hydrophilic, adhesion between the surface layer and the photosensitive layer, and electrophotographic characteristics, the surface layer of the present invention may further contain resins other than those described above, as well as crosslinking agents, plasticizers, and the like.

The crosslinking agent to be added includes generally employed organic peroxides, metallic soaps, organic silane compounds, polyurethane, and curing agents, e.g., epoxy resins. Specific examples of these crosslinking agents are described, e.g., in S. Yamashita and T. Kaneko (Eds.), *Kakyozai Handbook,* Taiseisha (1981).

Further, developing characteristics with a toner, adhesiveness of a toner image, or water retention after oil-desensitization processing can be improved by mechanically matting the surface layer or incorporating a matting agent into the surface layer. The matting agent to be added includes fillers, e.g., silicon dioxide, zinc oxide, titanium oxide, zirconium oxide, glass beads, alumina, clay, etc., and polymer particles, e.g., polymethyl methacrylate, polystyrene, phenolic resins, etc.

What is important in construction of the surface layer is that the non-image areas thereof should become sufficiently hydrophilic after oil-desensitization as mentioned before. The hydrophilic properties of the non-image areas can be confirmed, for example, by measuring a contact angle formed with water. While the contact angle with water of the surface layer before oil-desensitization is from about 60° to 120°, it is decreased to about 50 to 20° C. after oil-desensitization to attain high wettability by water. Hence, the resulting printing plate has formed thereon lipophilic toner image areas and highly hydrophilic non-image areas. It is preferable that the contact angle with water be decreased to 20° or less by oil-desensitization processing.

The lithographic printing plate precursor according to the present invention is particularly superior in hydrophilic properties on non-image areas as compared with conventional ones.

The electrophotographic photosensitive layer, i.e., photoconductive layer, to be used in the present invention can be formed by using any conventional photoconductive substances, either organic or inorganic.

The inorganic photoconductive substances which may be used include zinc oxide, titanium oxide, zinc sulfide, selenium, selenium alloys, cadmium sulfide, cadmium selenide, silicone, etc. These inorganic substances can be used to form a photoconductive layer either alone by deposition in vacuo, sputtering, or the like technique or in combination with a binder resin.

The organic photoconductive substances which can be used include high-molecular compounds, such as (1) the polyvinylcarbazole or derivatives thereof described in Japanese Patent Publication No. 10966/59, (2) the vinyl polymers described in Japanese Patent Publication Nos. 18674/68 and 19192/68, e.g., polyvinylpyrene, polyvinylanthracene, poly-2-vinyl-4-(4'-dimethylaminophenyl)-5-phenyl-oxazole, poly-3-vinyl-N-ethylcarbazole, etc., (3) the polymers described in Japanese Patent Publication No. 19193/68, e.g., polyacenaphthylene, polyindene, an acenaphthylene-styrene copolymer, etc., (4) condensed resins, e.g., a pyrene-formaldehyde resin, a bromopyrene-formaldehyde resin, an ethylcarbazoleformaldehyde resin, etc., as described in Japanese Patent Publication No. 13940/81, (5) the triphenylmethane polymers of various types described in Japanese Patent Application (OPI) Nos. 90833/81 and 161550/81, and the like; and low-molecular compounds, such as (6) triazole derivatives as described in U.S. Pat. No. 3,112,197, (7) oxadiazole derivatives as described in U.S. Pat. No. 3,189,447, (8) imidazole derivatives as described in Japanese Patent Publication No. 16096/62, (9) polyarylalkane derivatives as described in U.S. Pat. Nos. 3,615,402, 3,820,989, and 3,542,544, Japanese Patent Publication Nos. 555/70 and 10983/76, and Japanese Patent Application (OPI) Nos. 93224/76, 17105/80, 4148/81, 108667/80, 156953/80, and 36656/81, (10) pyrazoline derivatives and pyrazolone derivatives as described in U.S. Pat. Nos. 3,180,729 and 4,278,746 and Japanese Patent Application (OPI) Nos. 88064/80, 88065, 105537/74, 51086/80, 80051/81, 88141/81, 45545/82, 112637/79, and 74546/80, (11) phenylenediamine derivatives as described in U.S. Pat. No. 3,615,404, Japanese Patent Publication No. 10105/76, Japanese Patent Application (OPI) Nos. 83435/79, 110836/79, and 119925/79, and Japanese Patent Publication Nos. 3712/71 and 28336/72, (12) arylamine derivatives as described in U.S. Pat. No. 3,567,450, Japanese Patent Publication No. 35702/74, West German Patent (DAS) 1,110,518, U.S. Pat. Nos. 3,180,703,. 3,240,597, 3,658,520, 4,232,103, 4,175,961, and 4,012,376, Japanese Patent Application (OPI) Nos. 144250/80, 119132/81, and 22437/81, and Japanese Patent Publication No. 27577/64, (13) the amino-substituted chalcone derivatives described in U.S. Pat. No. 3,526,501, (14) N,N-bicarbazyl derivatives as described in U.S. Pat. No. 3,542,546, (15) oxazole derivatives as described in U.S. Pat. No. 3,257,203, (16) styrylanthracene derivatives as described in Japanese Patent Application (OPI) No. 46234/81, (17) fluorenone derivatives as described in Japanese Patent Application (OPI) No. 110837/79, (18) hydrazone derivatives as described in U.S. Pat. Nos. 3,717,462 and 415,098, Japanese Patent Application (OPI) Nos. 52063/80, 52064/80, 46760/80, 85495/80, 11350/82, and 148749/82, and the like.

These photoconductive substances can be used either individually or in combinations of two or more thereof.

Among the above-enumerated photoconductive substances, preferred are poly-N-vinylcarbazole; triarylamines, e.g., tri-p-tolylamine, triphenylamine, etc.; polyarylmethanes, e.g., 4,4'-bis(diethylamine)-2,2'-dimethyltriphenylmethane, etc.; and unsaturated heterocyclic ring-containing compounds exemplified by pyrazoline derivatives, e.g., 3-(4-dimethylaminophenyl)-1,5-diphenyl-2-pyrazoline, etc.

Binders to be combined with the photoconductive substance are conventional. Typical examples of the known binders are vinyl chloride-vinyl acetate copolymers, styrene-butadiene copolymers, styrene-butyl methacrylate copolymers, polymethacrylate, polyacrylate, polyvinyl acetate, polyvinyl butyral, alkyd resins, silicone resins, epoxy resins, epoxy ester resins, polyester resins, etc. The photoconductive substances may also be combined with aqueous acrylic emulsions or acrylic ester emulsions.

Specific examples of polymeric compounds which are useful as binder are given in *Research Disclosure,* Vol. 109, 61–67, "Electrophotographic Elements, Materials, and Methods".

The amount of the binder to be used in the photoconductive layer is generally subject to variation. The typical amount of the binder ranges from about 10 to about 90% by weight.

The resin of the invention may contain known spectral sensitizers, such as xanthene dyes, triphenylmethane dyes, azine dyes, metallized phthalocyanine dyes, polymethine dyes, etc. For the details of the spectral sensitizers, reference can be made to H. Miyamoto and H. Takei (Ed.), *Imaging,* Vol. 1973, No. 8, 2, "Recording Materials and Light-Sensitive Resins"; C.J. Young, *R.C.A. Review,* Vol. 15, 469 (1954); K. Koyoda, et al., *Denkitsushin Gakkai Ronbunshi* J63-C, No. 2, 97 (1980); Y. Harazaki et al., *Kogyo Kagaku Zasshi,* Vol. 66, 78 and 188 (1963); T. Tani, *Nippon Shasshin Gakkaishi,* Vol. 35, 208 (1972); *Research Disclosure,* Vol. 216, 117–118 (1982); and *Sogo Gijutsu Shiryoshu,* "Saikin no kododenzairyo to kankotai no kaihatsu jitsuyoka", Nippon Kagaku Joho K.K. (1986).

The photoconductive layer may be composed of a single layer or two or more layers. In the latter case, the layer structure includes a so-called separate function type photoconductive layer composed of a charge generating layer comprising a deposit of the above-described photoconductive substance or an organic pigment, e.g., a phthalocyanine dye and an azo dye, and, if desired, a binder resin and a charge transport layer comprising the above-recited high polymeric compound or low polymeric compound and a binder resin.

The photoconductive layer according to the present invention can be provided on any known support. In general, a support for an electrophotographic light-sensitive layer is preferably electrically conductive. Any of conventionally employed conductive supports may be utilized in this invention. Examples of usable conductive supports include a base (e.g., a metal sheet, paper, a plastic sheet, etc.) having been rendered electrically conductive by, for example, impregnating with a low resistant substance; a base with the back side thereof (opposite to the photosensitive layer side) being rendered conductive and further coated thereon at least one layer for the purpose of prevention of curling, etc.; the aforesaid bases having provided thereon a water-resistant adhesive layer; the aforesaid bases having provided thereon at least one precoat layer; paper laminated with a plastic film on which aluminum, etc. is deposited; and the like.

Specific examples of conductive supports and materials for imparting conductivity are described in S. Sakamoto, *Denshishashin,* Vol. 14, No. 1, 2–11 (1975), H. Moriga, *Nyumon tokushushi no kagaku,* Kobunshi Kankokai (1975), M.F. Hoover, *J. Macromol. Sci. Chem.,* A-4 (6), 1327–1417 (1970), etc.

The thickness of the photoconductive layer on the support can be selected from a broad range and usually ranges from about 10 to about 300 μm, and preferably from about 50 to about 150 μm, on a wet basis. Thickness outside of this range also gives satisfactory results. A suitable dry thickness of the photoconductive layer ranges from about 1 to about 50 μm.

The surface layer to be rendered hydrophilic has a thickness of 10 μm or less, and preferably between 0.1 and 5 μm for particular use for Carson processing. A surface layer thickness exceeding 5 μm would result in reduction of sensitivity of the photoreceptor and increase of residual potential.

In carrying out the production of the lithographic printing plate precursor of the present invention, an electrophotographic photosensitive layer (photoconductive layer) is formed on a conductive support in a usual manner. Then, a solution or dispersion of the resin according to the present invention and, if necessary, additives in a volatile hydrocarbon solvent having a boiling point of 200° C. or lower are coated on the photoconductive layer, followed by drying.

The organic solvent to be used preferably includes halogenated hydrocarbons having from 1 to 3 carbon atoms, e.g., dichloroethane, chloroform, 1,2-dichloroethane, tetrachloroethane, dichloropropane, and trichloroethane. It is also possible to use other various solvents commonly employed for coating, such as aromatic hydrocarbons (e.g., chlorobenzene, toluene, xylene, benzene, etc.), ketones (e.g., acetone, 2-butanone, etc.), ethers (e.g., tetrahydrofuran, etc.), methylene chloride, and so on, and mixtures thereof.

A toner image is then formed on the thus obtained printing plate precursor in accordance with ordinary electrophotographic processing, and the surface is treated with an oil-desensitizing solution, for example, an acidic or alkaline aqueous solution, and an aqueous solution of a reducing agent, thereby to render the non-image area hydrophilic.

In addition to the ordinary electrophotographic processing, formation of a toner image can be effected, for example, by (1) a method comprising forming an electrostatic latent image on a separate electrophotographic photoreceptor, electrostatically transferring the latent image to the printing plate precursor of the invention, and developing the transferred image to form a toner image, (2) a method comprising applying electrical signals to a multi-needle electrode to form an electrostatic latent image corresponding to the electrical signals on the photoreceptor and developing the latent image to obtain a toner image, or (3) a method comprising forming an electrostatic latent image on an electrophotographic photoreceptor in the form of a screen having a number of fine openings, subjecting the photoreceptor to corona discharge through the latent image to modulate the ionic stream of corona to form an electrostatic latent image, and developing the latent image with a toner. The present invention can be applied to any of these toner image formation systems. In such applications, a lithographic printing plate precursor comprising a conductive support having directly provided thereon the layer to be rendered hydrophilic is used.

Thus, use of the surface layer of the present invention which can be rendered hydrophilic makes it possible to utilize any of the known electrophotographic photoreceptors to form a high quality lithographic printing plate precursor. The surface layer achieves both highly hydrophilic properties and water resistance after oil-desensitization. Further, the surface layer exhibits very satisfactory adhesion to both the base and a toner image so that the resulting printing plate precursor has markedly improved resistance to background staining as well as high printing durability.

Since the lithographic printing plate precursor of the present invention substantially retains the sensitivity inherent to an electrophotographic photosensitive layer after storage, it has a much higher sensitivity as compared with conventional ones.

In the conventional techniques, since a photoconductive layer should combine photoconductivity with capability of becoming hydrophilic, the choice of materials has been confined to a narrow range, such as zinc oxide. In contrast, the lithographic printing plate precursor of the present invention may have its functions separated into a photoconductive layer and a surface layer to be rendered hydrophilic thereby broadening the range of choice of material. For instance, selection of a material having high sensitivity in the longer wavelength region would realize a recording system using an He-Ne laser or a semi-conductor laser, which has hitherto been impossible.

In addition, oil-desensitization of the printing plate precursor of the present invention to render non-image areas hydrophilic can be carried out simply by dipping the precursor in an oil-desensitizing solution for several seconds, thus making it possible to produce a printing plate by means of a small-sized and simple apparatus.

The present invention is now illustrated in greater detail with reference to Examples and Comparative Examples, but it should be understood that the present invention is not construed to be limited thereto. In these examples, all the percents are by weight unless otherwise specified.

EXAMPLE 1

In a mixed solvent of 30 ml of methylene chloride and 30 ml of ethylene chloride were dissolved 5 g of 4,4'-bis(diethylamino)-2,2'-dimethyltriphenylmethane as organic photoconductive substance, 5 g of polycarbonate of bisphenol A ("Lexan 121" produced by G.E. Co.), 40 mg of a spectral sensitizing dye of formula:

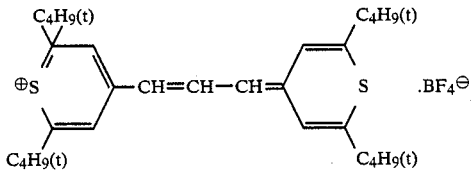

and, as a chemical sensitizer, 0.2 g of an anilide compound of formula:

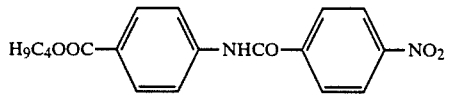

The resulting photosensitive was coated on a transparent conductive support composed of a 100 μm thickn polyethylene terephthalate film having a deposit film of indium oxide (surface resistivity: $10^3$ Ω) by means of a wire round rod to form an organic photosensitive layer having a thickness of about 4 μm.

Separately, a mixed solution consisting of 50 g of n-butyl methacrylate, 50 g of Compound (2) according to the present invention, and 400 g of toluene was heated to 75° C. in a nitrogen stream. To the mixture was added 1.5 g of azobisisobutyronitrile (AIBN), and the mixture was allowed to react for 9 hours. The resulting copolymer had a weight average molecular weight of 35,000.

A 5% toluene solution of the copolymer was coated on the above-prepared photoreceptor with a doctor blade to produce an electrophotographic lithographic printing plate precursor having a surface layer of about 2 μm in thickness.

The resulting printing plate precursor was passed once through an etching processor using an oil-desensitizing solution ("ELP-EX" produced by Fuji Photo Film Co., Ltd.) for oil-desensitization. When a drop of distilled water (2 μl) was placed on the thus processed surface, the contact angle formed with water was found to be 16° as measured by a goniometer. On comparing with the contact angle of 85° before the oil-desensitization, this result obviously demonstrates that the surface layer of the printing plate precursor was satisfactorily rendered hydrophilic.

The printing plate precursor was processed in an automatic plate making machine ("ELP 404V" manufactured by Fuji Photo Film Co., Ltd.) by using a negatively chargeable liquid developer to form a toner image and then subjected to oil-desensitization under the same conditions as described above. The resulting printing plate was mounted as offset master on an offset printing machine ("Hamada Star 800SX"manufactured by Hamada Star K.K.), and printing was carried out on fine paper.

As a result, 10,000 prints suffering from neither background stains on the non-image area nor reduction in image quality of the image area could be obtained.

EXAMPLE 2

A mixture of 5 g of a bisazo pigment of formula:

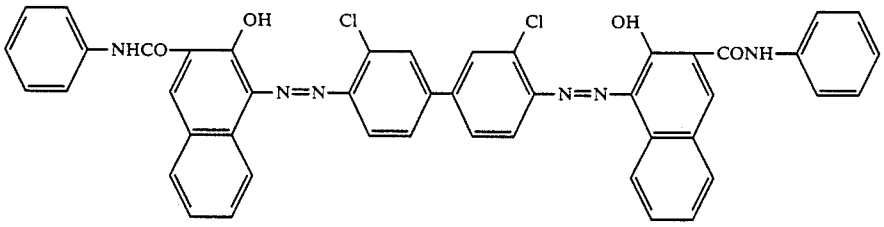

95 g of tetrahydrofuran, and 30 g of a 5% tetrahydrofuran solution of a polyvinyl butyral resin ("Denka Butyral #4000-1" produced by Electro Chemical Industry Co., Ltd.) was thoroughly ground in a ball mill. The mixture was taken out, and 520 g of tetrahydrofuran was added to the mixture while stirring. The resulting dispersion was coated on the same support as used in Example 1 with a wire round rod to form a charge generating layer having a thickness of about 0.7 μm.

Then, a mixture solution consisting of 20 g of a hydrazone compound of formula:

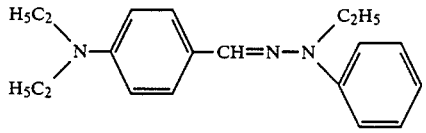

20 g of a polycarbonate resin ("Lexan 121" produced by G.E. Co.), and 160 g of tetrahydrofuran was coated with a wire round rod on the charge generating layer to form an approximately 18 μm thick electron transport layer. An electrophotographic photoreceptor having a double-layered photosensitive layer was obtained.

Separately, a mixed solution consisting of 60 g of n-butyl methacrylate, 40 g of Compound (4) of the present invention, and 200 g of toluene was heated to 75° C. in a nitrogen stream. To the mixture was added 1.5 g of AIBN, and the mixture was allowed to react for 8 hours. The resulting copolymer had a weight average molecular weight of 38,000.

A 5% toluene solution of the copolymer was coated with a doctor blade on the photosensitive layer to form a surface layer of about 2 μm in thickness.

For evaluation of electrostatic characteristics, the resulting lithographic printing plate precursor was charged to −6 kV by means of a paper analyzer ("SP-428" manufactured by Kawaguchi Denshi K.K.), and the initial potential ($V_0$), dark charge retention (DRR), and half decay exposure ($E_{\frac{1}{2}}$) were measured. As a result, $V_0 = -550$ V, DRR = 85%, and $E_{\frac{1}{2}} = 55.5$ erg/cm$^2$ were found.

The printing plate precursor was processed in an automatic plate making machine "ELP 404V" using a toner "ELP-T". The resulting master plate for offset printing had a density of 1.0 or more and a clear image. After etching processing, the master plate was mounted on a printing machine to effect printing. The print after obtaining 10,000 prints had a clear image without any fog on the non-image area.

EXAMPLE 3

A mixed solution consisting of 27 g of ethyl methacrylate, 70 g of Compound (26) of the present invention, 3 g of 2-hydroxyethyl methacrylate, and 200 g of toluene was subjected to polymerization reaction under the same conditions as in Example 2. The resulting copolymer had a weight average molecular weight of 38,000.

To 20 g of a 5% toluene solution of the copolymer was added 0.15 g of toluene, 2,4-diisocyanate, and the resulting solution was coated on the same photoreceptor having a double-layered photosensitive layer as prepared in Example 2 by means of a doctor blade, dried at 110° C. for 1 minute, and then heat-treated at 150° C. for 30 minutes to form an approximately 1.8 μm thick surface layer.

Electrostatic characteristics of the resulting lithographic printing plate precursor as determined in the same manner as in Example 2 and were found to be as follows.

$V_0 = -540$ V

DRR = 84%

$E_{\frac{1}{2}} = 54.5$ erg/cm$^2$.

Then, the printing plate precursor was processed in ELP-404V in the same manner as in Example 2. The resulting master print for offset printing had a density of 1.0 or more and a clear image. After etching processing, the master plate was used for printing. The print after obtaining 10,000 prints had a clear image free from fog on the non-image area.

EXAMPLES 4 to 6

In the same manner as described in Example 1, copolymers (D), (E), and (F) having structures in the weight percentages shown in Table 1 below were prepared.

TABLE 1

| Resin | Structure |
|---|---|
| (D) | 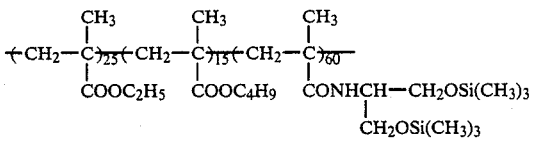 |
| (E) | 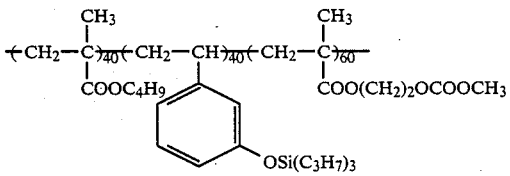 |
| (F) | 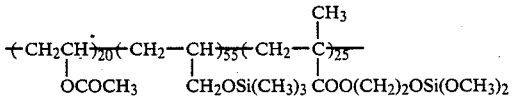 |

A lithographic printing plate precursor was produced in the same manner as in Example 1, except for replacing the resin used in the surface layer in Example 1 with each of resins (D) to (F).

The resulting precursors were evaluated for electrostatic characteristics in the same manner as in Example 2. Each of the precursors were then processed in an automatic plate making machine "ELP-404V", and printing was carried out in the same manner as in Example 1 to determine printing durability. The results obtained are shown in Table 2. As is apparent from Table 2, these results are similar to those of Examples 1 and 2.

TABLE 2

| Resin | Example 4 (D) | Example 5 (E) | Example 6 (F) |
|---|---|---|---|
| Electrostatic Characteristics: | | | |
| $V_0$ (V) | 570 | 580 | 565 |
| DRR (%) | 84 | 86 | 83 |
| $E_{\frac{1}{2}}$ (erg/cm$^2$) | 57.3 | 56.2 | 56.0 |
| Image Quality After Plate Making: | | | |
| Density | 1.0 or more | 1.0 or more | 1.0 or more |
| Image Quality | clear | clear | clear |
| Printing Durability | 10,000 or more | 10,000 or more | 10,000 or more |

EXAMPLE 7

A mixed solution consisting of 30 g of n-butyl methacrylate, 20 g of a monomer corresponding to Copolymer Component (41) of the present invention, and 200 g of toluene was heated to 70° C. in a nitrogen stream, and 1.0 g of AIBN was added thereto. The mixture was allowed to react for 8 hours. The resulting copolymer had a weight average molecular weight of 43,000.

A lithographic printing plate precursor was produced in the same manner as in Example 1, except for replacing the resin used in the surface layer of Example 1 with the above-prepared resin.

A contact angle formed by the resulting printing plate precursor and distilled water before and after oil-desensitization was measured in the same manner as in Example 1 and was found to be 85° and 18°, respectively, indicating that the surface layer of the precursor was satisfactorily rendered hydrophilic by the oil-desensitization processing.

When a printing plate produced from the precursor was tested for printing performance in the same manner as in Example 1, results similar to those of Example 1 were obtained.

EXAMPLE 8

In the same manner as in Example 2, a double-layered photosensitive layer was formed on the same transparent conductive support as used in Example 1 to obtain an electrophotographic photoreceptor.

A mixed solution consisting of 20 g of benzyl methacrylate, 30 g of ethyl methacrylate, 50 g of Copolymer Component (51) of the present invention, and 300 g of toluene was heated to 75° C. in a nitrogen stream. After adding 1.0 g of AIBN thereto, the mixture was allowed to react for 8 hours. The resulting copolymer had a weight average molecular weight of 45,000.

A 5% toluene solution of the copolymer was coated with a doctor blade on the double-layered photosensitive layer to form a surface layer having a thickness of about 2 μm.

The electrostatic characteristics of the resulting printing plate precursor were determined in the same manner as in Example 2. The results were:

$V_0 = -580$ V

DRR = 87%, and $E_{\frac{1}{2}} = 56$ erg/cm$^2$.

A master plate for offset printing obtained from the printing plate precursor in the same manner as in Example 1 had a density of 1.0 or more and a clear image. After etching processing, printing test was carried out. The print after obtaining 10,000 prints had a clear image free from fog on the non-image area.

EXAMPLE 9

A mixed solution consisting of 37 g of n-butyl methacrylate, 60 g of Compound (51) of the present invention, 3 g of 2-hydroxyethyl methacrylate, and 200 g of toluene was subjected to polymerization reaction under the same conditions as in Example 8. The resulting copolymer had a weight average molecular weight of 38,000.

To 20 g of a 5% toluene solution of the copolymer was added 0.15 g of toluene, 2,4-diisocyanate, and the resulting solution was coated with a doctor blade on the same photoreceptor having a double-layered photosensitive layer as prepared in Example 8, dried at 110° C. for 1 minute, and further heat-treated at 150° C. for 30 minutes to form a surface layer having a thickness of approximately 1.8 μm.

The electrostatic characteristics of the precursor as analyzed in the same manner as in Example 2 were:

$V_0 = -540$ V

DRR = 84%, and $E_{\frac{1}{2}} = 54.5$ erg/cm$^2$.

A master plate for offset printing obtained from the printing plate precursor in the same manner as in Example 1 had a density of 1.0 or more and a clear image. After etching processing, a printing test was carried out. The print after obtaining 10,000 prints had a clear image free from fog on the non-image area.

EXAMPLE 10

A mixed solution consisting of 40 g of butyl vinyl ether, 10 g of 4-methylene-1,3-dioxoran, and 100 g of ethyl ether was cooled to −78° C. in a nitrogen stream, and 5 g of a boron trifluoride ethyl etherate was added thereto while stirring, followed by reacting for 60 hours. A methanolic solution of ammonia was added to the reaction system to step the polymerization. The precipitated polymer was separated from the solvent by decantation, washed with n-hexane, and dried under reduced pressure.

A 5% toluene solution containing the above prepared copolymer and a butyl methacrylate/acrylic acid (98/2 by weight) copolymer at a weight ratio of 8/2 was coated on the same photoreceptor as prepared in Example 8 with a doctor blade and dried at 110° C. for 1 minute to form a surface layer having a thickness of about 1.8 μm.

As a result of analyses on electrostatic characteristics in the same manner as in Example 2, it was determined that $V_0 = -560$ V, DRR = 86%, and $E_{\frac{1}{2}} = 56$ erg/cm$^2$.

A master plate for offset printing obtained from the printing plate precursor in the same manner as in Example 1 had a density of 1.0 or more and a clear image. After etching processing, a printing test was carried out. The print after obtaining 10,000 prints had a clear image free from fog on the non-image area.

EXAMPLES 11 to 13

A lithographic printing plate precursor was produced in the same manner as in Example 7, except for replacing the resin used in the surface layer of Example 7 with each of the resins (G), (H), and (I) shown in Table 3.

The electrostatic characteristics of the resulting precursor were determined in the same manner as in Example 2. An offset master plate obtained from the precursor in the same manner as in Example 1 was subjected to a printing test. The results obtained are shown in Table 4.

TABLE 3

| Example No. | Resin | Monomers | Weight Ratio |
|---|---|---|---|
| 11 | (G) | n-butyl methacrylate | 50 |
| | | monomer corresponding to Component (42) | 50 |
| 12 | (H) | n-butyl methacrylate | 40 |
| | | monomer corresponding to Component (42) | 60 |
| 13 | (I) | ethyl methacrylate | 50 |
| | | monomer corresponding to Component (52) | 50 |

TABLE 4

| Resin | Example 11 (G) | Example 12 (H) | Example 13 (I) |
|---|---|---|---|
| Electrostatic Characteristics: | | | |
| $V_0$ (V) | 580 | 570 | 560 |
| DRR (%) | 85 | 85 | 86 |
| $E_{\frac{1}{2}}$ (erg/cm$^2$) | 56.5 | 55.2 | 54.3 |
| Image Quality After Plate Making: | | | |
| Density | 1.0 or more | 1.0 or more | 1.0 or more |
| Image Quality | clear | clear | clear |
| Printing Durability | 10,000 or more | 10,000 or more | 10,000 or more |

The results of Table 4 are similar to those of Examples 7 and 8.

As described above, the surface layer comprising the specific resin according to the present invention achieves both high hydrophilic properties and water resistance upon oil-desensitization and also exhibits excellent adhesion to a base as well as retentiveness of toner image. Hence, the electrophotographic lithographic printing plate precursor having such a surface layer possesses superior quality in both background stain resistance and printing durability. To additional advantage, the resins to be used in the present invention can be prepared easily.

While the invention has been described in detail and with reference to specific embodiments thereof, it will be apparent to one skilled in the art that various changes and modifications can be made therein without departing from the spirit and scope thereof.

What is claimed is:

1. A lithographic printing plate precursor comprising an electrophotographic photoreceptor which comprises a conductive support having thereon at least one photoconductive layer and an outermost surface layer, used for producing an image on the photoconductive layer and then subjecting at least the surface layer to an oil-desensitization treatment, in which said surface layer contains, as the main functional component, at least one resin selected from the group consisting of (A) a resin obtained by polymerizing at least one monomer having at least one functional group which is capable of forming a hydroxyl group upon decomposition of the oil-desensitization treatment and which is represented by formula:

$$-O-L$$

wherein L represents $$-\overset{\overset{R_1}{|}}{\underset{\underset{R_3}{|}}{Si}}-R_2,\ -CO-Y_1,\ -CO-Z-Y_2,\ -CH=CH-CH_3,$$

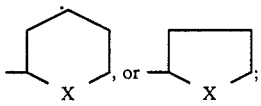

wherein $R_1$, $R_2$, and $R_3$, which may be the same or different, each represents a hydrogen atom, a hydrocarbon group or —O—R′, wherein R′ represents a hydrocarbon group; $Y_1$ and $Y_2$ each represents a hydrocarbon group; Z represents an oxygen atom, a sulfur atom or —NH—; and X represents a sulfur atom or an oxygen atom, in the side chain thereof, and (B) a resin obtaining by polymerizing at least one monomer having at least one functional group in which at least two hydroxyl groups sterically near to each other are simultaneously protected with one protective group, and which is capable of forming at least two hydroxyl groups upon decomposition by the oil-desensitization treatment.

2. A lithographic printing plate precursor as in claim 1, wherein said monomer having at least one functional group of formula (—O—L) in the side chain thereof is a compound represented by formula (I):

$$\overset{a_1}{\underset{|}{CH}}=\overset{a_2}{\underset{|}{C}}-X'-Y'-O-L \qquad (I)$$

wherein X′ represents —O—, —CO—, —COO—, —OCO—, $$-\overset{Q_1}{\underset{|}{N}}CO-,\ -CO\overset{Q_2}{\underset{|}{N}}-,\ -SO_2-,\ -SO_2\overset{Q_3}{\underset{|}{N}}-,\ -\overset{Q_4}{\underset{|}{N}}SO_2-,$$

-continued $$-CH_2COO-,\ -CH_2OCO-,\ \left(\overset{b_1}{\underset{b_2}{C}}\right)_n,$$

an aromatic group or a heterocyclic ring, wherein $Q_1$, $Q_2$, $Q_3$, and $Q_4$ each represents a hydrogen atom, a hydrocarbon group or the group (Y′—O—L) in formula (I); $b_1$ and $b_2$, which may be the same or different, each represents a hydrogen atom, a hydrocarbon group or the group (Y′—O—L) in formula (I); and n represents 0 or an integer of from 1 to 18; Y′ represents a carbon-carbon bond or linking group which may contain a hetero atom; and $a_1$ and $a_2$, which may be the same or different, each represents a hydrogen atom, a hydrocarbon group, —COOH or —COOW, wherein W represents a substituted or unsubstituted alkyl group having from 1 to 18 carbon atoms, a substituted or unsubstituted alkenyl group, a substituted or unsubstituted aralkyl group, a substituted or unsubstituted alicyclic group or a substituted or unsubstituted aromatic group.

3. A lithographic printing plate precursor as claimed in claim 1, wherein said functional group in which at least two hydroxyl groups sterically near to each other are simultaneously protected with one protective group is selected from a group represented by formula (II):

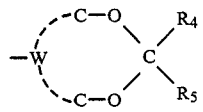

(II)

wherein $R_4$ and $R_5$, which may be the same or different, each represents a hydrogen atom, a hydrocarbon group or —O—R″, wherein R″ represents a hydrocarbon group; and W represents a carbon-carbon bond or bonding group which may contain a hetero atom, the number of atoms between the oxygen atoms shown in formula (II) being limited to 5 or less, a group represented by formula (III):

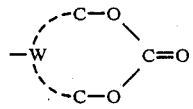

(III)

wherein W is as defined above, a group represented by formula (IV):

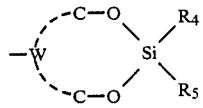

(IV)

wherein $R_4$, $R_5$, and W are as defined above, and a group represented by formula (V):

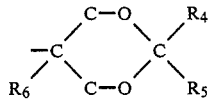

(V)

wherein $R_4$ and $R_5$ are as defined above, and $R_6$ represents a hydrogen atom or an alkyl group having 1 to 4 carbon atoms, for example, a methyl, ethyl, propyl or butyl group.

4. A lithographic printing plate precursor as in claim 1, wherein said resin contains from 40 to 100% by weight of a polymer component having said functional group based on the total resin.

5. A lithographic printing plate precursor as in claim 1, wherein $R_1$, $R_2$ and $R_3$, which may be the same or different, each represents a hydrogen atom, a substituted or unsubstituted straight or branched chain alkyl group having from 1 to 18 carbon atoms, a substituted or unsubstituted aralkyl group having from 7 to 12 carbon atoms, a substituted or unsubstituted aromatic group, or —O—R′, wherein R′ represents a hydrocarbon group as defined for $R_1$, $R_2$, and $R_3$.

6. A lithographic printing plate precursor as in claim 1, wherein L represents a substituent selected from the group consisting of —CO—$Y_1$, wherein $Y_1$ represents a substituted or unsubstituted straight chain or branched chain alkyl group having 1 to 6 carbon atoms, a substituted or unsubstituted aralkyl group having from 7 to 9 carbon atoms or a substituted or unsubstituted aryl group having from 6 to 12 carbon atoms, —CO—Z—$Y_2$, wherein Z represents an oxygen atom, a sulfur atom or an —NH— bond; and $Y_2$ has the same meaning as $Y_1$; and

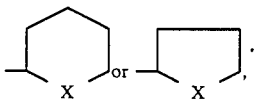

wherein X represents an oxygen atom or a sulfur atom.

7. A lithographic printing plate precursor as in claim 3, wherein $R_4$ and $R_5$, which may be the same or different, each represents a hydrogen atom, a substituted or unsubstituted alkyl group having from 1 to 12 carbon atoms, a substituted or unsubstituted aralkyl group having from 7 to 9 carbon atoms, an alicyclic group having from 5 to 7 carbon atoms, a substituted or unsubstituted aryl group or —O—R″, wherein R″ represents a hydrocarbon group, as recited for $R_4$ or $R_5$.

8. A lithographic printing plate precursor as in claim 1, wherein the molecular weight of said resin (A) or (B) is from $1\times10^3$ to $1\times10^6$.

9. A lithographic printing plate precursor as in claim 1, wherein the proportion of said resin comprising the main functional component of said surface layer is from 40 to 100% by weight of the total resin in said surface layer.

10. A lithographic printing plate precursor as in claim 1, wherein said resin comprising the main functional component of the surface layer is represented by

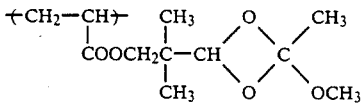

or

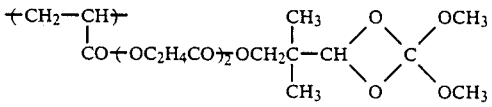

11. A process for producing a lithographic printing plate comprising the step of electrophotographing forming an image on the printing plate precursor as claimed in claim 1, and then subjecting the resulting printing plate precursor to an oil-desensitization treatment.

* * * * *